US009826614B1

(12) United States Patent
Bakeman et al.

(10) Patent No.: US 9,826,614 B1
(45) Date of Patent: Nov. 21, 2017

(54) COMPAC X-RAY SOURCE FOR SEMICONDUCTOR METROLOGY

(71) Applicant: KLA-Tencor Corporation, Milpitas, CA (US)

(72) Inventors: Michael S. Bakeman, Union City, CA (US); Andrei V. Shchegrov, Campbell, CA (US)

(73) Assignee: KLA-Tencor Corporation, Milpitas, CA (US)

( * ) Notice: Subject to any disclaimer, the term of this patent is extended or adjusted under 35 U.S.C. 154(b) by 69 days.

(21) Appl. No.: 14/181,697

(22) Filed: Feb. 16, 2014

Related U.S. Application Data

(60) Provisional application No. 61/790,862, filed on Mar. 15, 2013.

(51) Int. Cl.
*H05G 2/00* (2006.01)

(52) U.S. Cl.
CPC ..... *H05G 2/00* (2013.01); *H05G 2/008* (2013.01)

(58) Field of Classification Search
CPC ..... G01N 23/02; G01N 23/04; G01N 23/201; G01N 23/06; G01N 23/063; G01N 23/083; G01N 23/20; H05G 2/00; H05G 2/008
See application file for complete search history.

(56) References Cited

U.S. PATENT DOCUMENTS 5,923,720 A * 7/1999 Barton ..... B82Y 10/00 378/83
6,389,101 B1 * 5/2002 Levine ..... G01N 23/046 378/145
6,529,264 B1 * 3/2003 Ikeda ..... G03F 7/70225 355/53
7,019,522 B1 * 3/2006 Johnson ..... G01R 33/025 324/260
7,130,375 B1 * 10/2006 Yun ..... G01N 23/04 378/205
7,929,667 B1 4/2011 Zhuang et al.
(Continued)

OTHER PUBLICATIONS

Geddes et al, "High Quality Electron Beams from a Laser Wakefield Accelerator Using Plasma-Channel Guiding", Nature vol. 431 2004 p. 538-541.*

(Continued)

*Primary Examiner* — David E Smith
(74) *Attorney, Agent, or Firm* — Spano Law Group; Joseph S. Spano

(57) ABSTRACT

Methods and systems for realizing a high brightness, compact x-ray source suitable for high throughput, in-line x-ray metrology are presented herein. A compact electron beam accelerator is coupled to a compact undulator to produce a high brightness, compact x-ray source capable of generating x-ray radiation with wavelengths of approximately one Angstrom or less with a flux of at least 1e10 photons/s*mm^2. In some embodiments, the electron path length through the electron beam accelerator is less than ten meters and the electron path length through the undulator is also less than 10 meters. The compact x-ray source is tunable, allowing for adjustments of both wavelength and flux of the generated x-ray radiation. The x-ray radiation generated by the compact x-ray source is delivered to the specimen over a small spot, thus enabling measurements of modern semiconductor structures.

20 Claims, 7 Drawing Sheets

(56) References Cited

U.S. PATENT DOCUMENTS

| | | | | |
|---|---|---|---|---|
| 7,994,472 | B2 * | 8/2011 | Plettner | H05H 7/06 250/251 |
| 2005/0147147 | A1 * | 7/2005 | Umstadter | H01S 3/30 372/73 |
| 2005/0213708 | A1 * | 9/2005 | Lawrence | H01S 3/083 378/119 |
| 2006/0222147 | A1 * | 10/2006 | Filkins | H05G 2/00 378/119 |
| 2007/0014392 | A1 * | 1/2007 | Madey | H05G 2/00 378/119 |
| 2007/0085009 | A1 * | 4/2007 | Adamski | G01J 3/42 250/341.8 |
| 2008/0219297 | A1 * | 9/2008 | Yamada | H01S 4/00 372/5 |
| 2009/0161829 | A1 * | 6/2009 | Chen | B82Y 10/00 378/84 |
| 2010/0044598 | A1 * | 2/2010 | Brownell | H01S 3/0903 250/504 R |
| 2011/0255668 | A1 * | 10/2011 | Hoghoj | B82Y 10/00 378/132 |
| 2012/0288065 | A1 * | 11/2012 | Graves | H05G 2/00 378/119 |
| 2014/0176270 | A1 * | 6/2014 | Temnykh | H01S 3/0903 335/306 |

OTHER PUBLICATIONS

J.M.J. Madey, et al., "Optimized Cavity-Enhanced X-Ray Sources for X-Ray Microscopy," Proc. of SPIE vol. 8851, X-Ray Nanoimaging: Instruments and Methods, 88510W-1-9, Sep. 26, 2013.

O. Hemberg, et al., "Liquid-metal-jet anode electron-impact x-ray source," Appl. Phys. Lett. 83, 1483 (2003).

M.S. Bakeman, "An Undulator-Based Laser Wakefield Accelerator Electron Beam Diagnostic", Ph.D. Thesis, University of Nevada, Reno, 2011.

A. Debus, "Brilliant radiation sources by laser-plasma accelerators and optical undulators", Ph.D. Thesis, Helmholtz-Zentrum Dresden-Rossendorf (HZDR), 2011.

D.K. Bowen and B.K. Tanner, "High Resolution X-ray Diffractometry and Topography", Taylor and Francis, London, 1998.

W.P. Leemans et al., "GeV electron beams from a centimeter-scale accelerator", Nature Physics 2 699 (2006).

C.B. Schroeder et al., "Free-electron laser driven by the LBNL laser-plasma accelerator", Proceedings of the Thirteenth Advanced Accelerator Concepts Workshop. AIP Conference Proceedings, vol. 1086, pp. 637-642 (2009).

W.P. Leemans et al., "The BErkeley Lab Laser Accelerator (BELLA): A 10 GeV Laser Plasma Accelerator", Proceedings of the Fourteenth Advanced Accelerator Concepts Workshop. AIP Conference Proceedings, vol. 1299, pp. 3-11 (2010).

* cited by examiner

COMPAC X-RAY SOURCE FOR SEMICONDUCTOR METROLOGY

CROSS REFERENCE TO RELATED APPLICATION

The present application for patent claims priority under 35 U.S.C. §119 from U.S. provisional patent application Ser. No. 61/790,862, entitled "Metrology Apparatus Using A Compact X-Ray Source," filed Mar. 15, 2013, the subject matter of which is incorporated herein by reference in its entirety.

TECHNICAL FIELD

The described embodiments relate to metrology systems and methods, and more particularly to methods and systems for improved illumination.

BACKGROUND INFORMATION

Semiconductor devices such as logic and memory devices are typically fabricated by a sequence of processing steps applied to a specimen. The various features and multiple structural levels of the semiconductor devices are formed by these processing steps. For example, lithography among others is one semiconductor fabrication process that involves generating a pattern on a semiconductor wafer. Additional examples of semiconductor fabrication processes include, but are not limited to, chemical-mechanical polishing, etch, deposition, and ion implantation. Multiple semiconductor devices may be fabricated on a single semiconductor wafer and then separated into individual semiconductor devices.

Metrology processes are used at various steps during a semiconductor manufacturing process to detect defects on wafers to promote higher yield. Optical metrology techniques offer the potential for high throughput without the risk of sample destruction. A number of optical metrology based techniques including scatterometry and reflectometry implementations and associated analysis algorithms are commonly used to characterize critical dimensions, film thicknesses, composition and other parameters of nanoscale structures.

As devices (e.g., logic and memory devices) move toward smaller nanometer-scale dimensions, characterization becomes more difficult. Devices incorporating complex three-dimensional geometry and materials with diverse physical properties contribute to characterization difficulty. For example, modern memory structures are often high-aspect ratio, three-dimensional structures that make it difficult for optical radiation to penetrate to the bottom layers. In addition, the increasing number of parameters required to characterize complex structures (e.g., FinFETs), leads to increasing parameter correlation. As a result, the parameters characterizing the target often cannot be reliably decoupled with available measurements. In another example, opaque, high-k materials are increasingly employed in modern semiconductor structures. Optical radiation is often unable to penetrate layers constructed of these materials. As a result, measurements with thin-film scatterometry tools such as ellipsometers or reflectometers are becoming increasingly challenging.

In response, more complex optical tools have been developed. For example, tools with multiple angles of illumination, shorter and broader ranges of illumination wavelengths, and more complete information acquisition from reflected signals (e.g., measuring multiple Mueller matrix elements in addition to the more conventional reflectivity or ellipsometric signals) have been developed. However, these approaches have not reliably overcome fundamental challenges associated with measurement of many advanced targets (e.g., complex 3D structures, structures smaller than 10 nm, structures employing opaque materials) and measurement applications (e.g., line edge roughness and line width roughness measurements).

Another response to these recent challenges has been the adoption of x-ray metrology for measurements including film thickness, composition, strain, surface roughness, line edge roughness, and porosity. Many x-ray metrology techniques used in semiconductor manufacturing can benefit from high brightness x-ray sources. For example, many semiconductor structures are weakly scattering in the high energy X-ray regime and brighter sources reduce the measurement time. In one example, critical dimension small angle x-ray scattering (CD-SAXS) measurements often require long integration times due to the low scattering of certain materials. A high brightness source can improve the throughput of CD-SAXS measurements.

A higher brightness X-ray source would also enable measurements of small area targets. Currently, metrology targets having dimensions of 50 microns by 50 microns are often placed within scribe lines of a semiconductor wafer. The industry trend is to further reduce the dimensions of these targets, and in some cases, perform measurements in-die. In these examples, measurements must be performed on measurement targets having dimensions of 10 microns by 10 microns, or smaller.

X-ray sources including electron beam sources with water cooled targets and solid, rotating anodes have been employed. A promising high brightness X-ray source is a liquid metal jet X-ray source having a liquid metal anode. Unfortunately, for both conventional solid and liquid anode sources, measurement throughput has been impaired by limited power loading on the anode. An increase in power loading of a conventional solid metal anode source causes ablation and destruction of the anode. For typical liquid metal anode sources, an increase in power loading produces excessive metal vapor that damages the cathode. In addition, liquid metal jet sources typically employ an alloy having a low melting temperature. This limits the number of suitable materials. This, in turn, limits the number of x-ray emission lines and energies available from the liquid metal jet source.

Most state-of-the art CD-SAXS measurements on semiconductor device targets have been performed using high-brightness synchrotron x-ray sources. Synchrotron beamline facilities provide access to collimated, high-flux X-ray radiation and an opportunity to select the energy of the X-ray photons. While these sources are suitable for research purposes, the size and cost associated with synchrotron facilities prohibits their use as part of an inline semiconductor metrology system.

Future metrology applications present challenges for metrology due to increasingly small resolution requirements, multi-parameter correlation, increasingly complex geometric structures, and increasing use of opaque materials. The adoption of x-ray metrology for semiconductor applications requires improved x-ray sources with the highest possible brightness. An x-ray source sized for practical use within an inline semiconductor metrology system and having sufficient brightness to perform x-ray scattering and diffraction measurements of small targets is desired.

SUMMARY

Methods and systems for realizing a high brightness, compact x-ray source suitable for high throughput, in-line x-ray metrology are presented herein.

In one aspect, a compact electron beam accelerator is coupled to a compact undulator to produce a high brightness, compact x-ray source capable of generating x-ray radiation with wavelengths of approximately one Angstrom or less with a flux of at least 1e10 photons/s*mm^2.

The compact electron beam accelerator is sized to be compatible with a modern semiconductor fabrication facility. In some embodiments, the electron path length of the electron beam accelerator is less than 10 meters. In some embodiments, the electron beam accelerator 103 is plasma based. In some other embodiments, the electron beam accelerator is RF based.

The undulator is also sized to be compatible with a modern semiconductor fabrication facility. In some embodiments, the electron path length through undulator 106 is also less than 10 meters. In some embodiments, undulator 106 is a permanent magnet based undulator. In some other embodiments, the undulator is based on a dielectric grating structure. In some other embodiments, the undulator is an optical undulator.

In a further aspect, the compact x-ray source is tunable, allowing for adjustments of both the wavelength and flux of the generated x-ray radiation. In some examples, the electron beam energy generated by the compact electron beam accelerator is controlled to tune the wavelength of x-ray radiation emitted from the undulator. In some other examples, operational parameters of the undulator are controlled to tune the wavelength of the x-ray radiation incident on the specimen. In some examples, the x-ray wavelengths are adjusted to specific absorption edges and scattering edges to improve measurement performance.

In another further aspect, the compact x-ray source delivers x-ray illumination to the specimen with low noise. A low noise electron source, combined with low noise electron beam optics and high efficiency x-ray optics ensure that the x-ray illumination delivered to the specimen enables low noise measurements.

In another further aspect, in-die metrology of semiconductor targets is enabled by high-brightness x-ray radiation focused to a small spot size. In some embodiments, advanced x-ray optics such as polycapillary x-ray optics, specular optics, or optics arranged in a Loxley-Tanner-Bowen configuration are employed to achieve high-brightness, small spot size illumination of a semiconductor specimen. In some other embodiments, x-ray illumination is emitted from the undulator at very low beam divergence, and the radiation illuminates the specimen directly over a small spot size without the use of x-ray optics.

In another further aspect, x-ray metrology system 100 is configured such that x-rays which interact with the specimen are collected by a detector while a sample handler positions the specimen to produce angularly resolved interactions of the sample with the x-rays. In addition, other particles produced during the interaction such as photoelectrons, x-rays produced through fluorescence, or ions are also detected.

The foregoing is a summary and thus contains, by necessity, simplifications, generalizations and omissions of detail; consequently, those skilled in the art will appreciate that the summary is illustrative only and is not limiting in any way. Other aspects, inventive features, and advantages of the devices and/or processes described herein will become apparent in the non-limiting detailed description set forth herein.

DETAILED DESCRIPTION

Reference will now be made in detail to background examples and some embodiments of the invention, examples of which are illustrated in the accompanying drawings.

Systems employed to measure structural and material characteristics (e.g., material composition, dimensional characteristics of structures and films, etc.) associated with different semiconductor fabrication processes based on x-ray illumination are presented. More specifically, methods and systems for realizing a compact, high brightness x-ray source suitable for high throughput, inline, x-ray metrology are presented herein.

In one aspect, a compact electron beam accelerator is coupled to a compact undulator to produce a high brightness, compact x-ray source. Such a source is suitably sized for installation in modern semiconductor fabrication facilities. Furthermore, the x-ray source is capable of supplying short wavelength x-ray radiation at flux levels sufficient to enable high-throughput, inline metrology.

The high energy nature of x-ray radiation allows for the penetration of x-rays into optically opaque thin films, buried structures, high-aspect ratio structures and devices containing many film layers. For example, silicon substrates having approximately 0.75 millimeter thickness are commonly employed in the semiconductor industry. The compact x-ray source described herein enables measurement technologies that require the x-ray beam to penetrate these substrates with x-ray wavelengths of approximately one Angstrom or less with a flux level of at least 1e10-1e12 photons/s*mm^2.

In a further aspect, the compact x-ray source is tunable, allowing for adjustments of both the wavelength and flux of the generated x-ray radiation. For example, the wavelength of the x-ray radiation incident on the specimen can be adjusted to specific absorption edges and scattering edges. In some examples, measurements are performed with increased scattering contrast (i.e., resonant scattering) by adjusting the wavelength of the x-ray radiation to closely match a resonant frequency of the atomic scattering factor of the target structure under measurement. In this manner, materials having relatively low electron density contrast can be successfully measured based on resonant scattering.

In another further aspect, the compact x-ray source delivers x-ray illumination to the specimen with low noise. A low noise electron source, combined with low noise electron beam optics and high efficiency x-ray optics ensure that the x-ray illumination delivered to the specimen enables low noise measurements.

In another further aspect, x-ray metrology system 100 is configured such that x-rays which interact with the specimen are collected by a detector while a sample handler positions the specimen to produce angularly resolved interactions of the sample with the x-rays. In addition, other particles produced during the interaction such as photoelectrons, x-rays produced through fluorescence, or ions are also detected.

Figure 1:
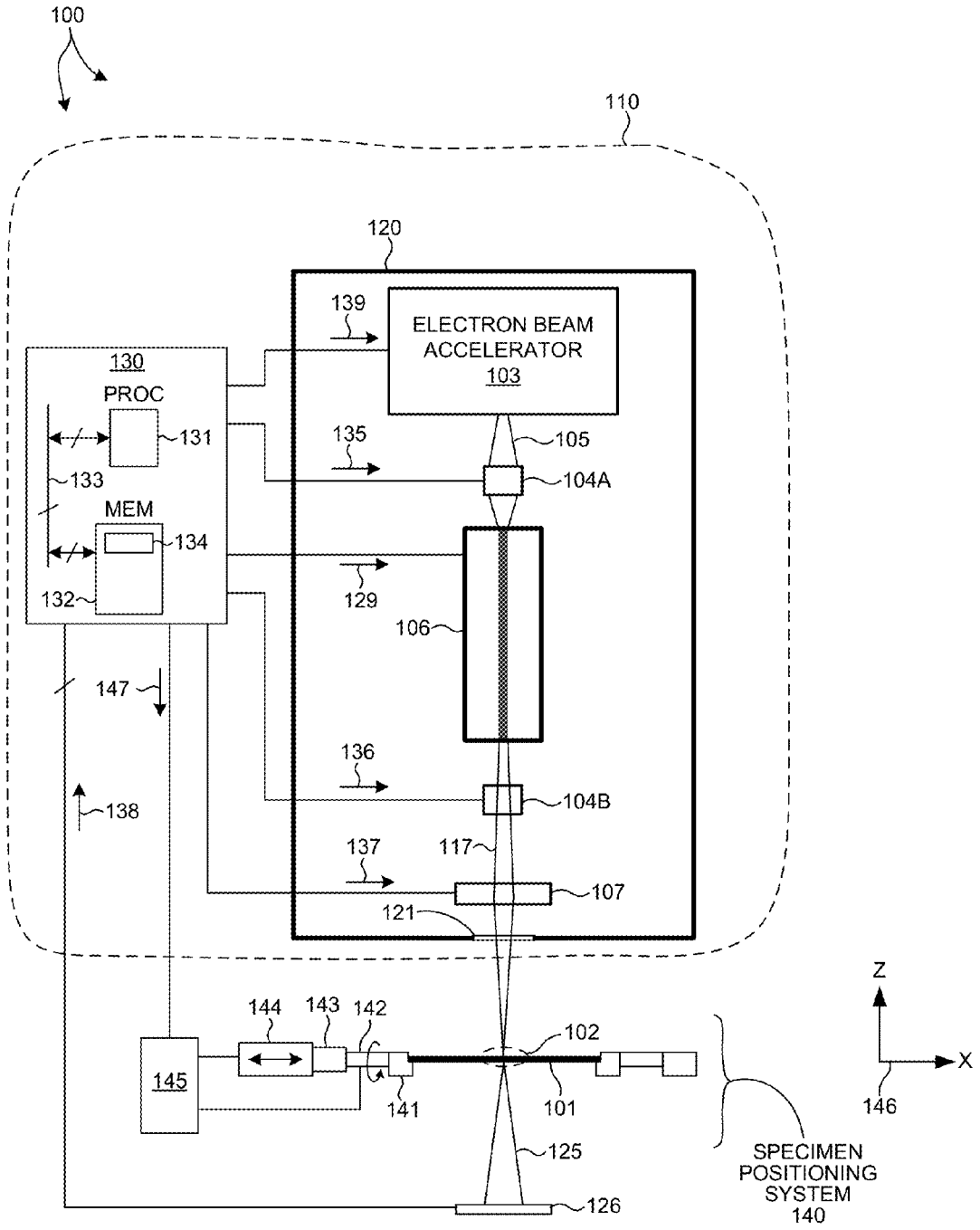
FIG. 1 is a diagram illustrative of an x-ray metrology system 100 for performing semiconductor metrology measurements including a compact x-ray source 110.

FIG. 1 illustrates an embodiment of a compact x-ray illumination source 110 in at least one novel aspect. In the depicted embodiment, x-ray source 110 delivers high brightness x-ray illumination to a specimen 101 over an inspection area 102. In some embodiments, the inspection area 102 has a spot size of fifty micrometers or less. In some embodiments, the inspection area 102 has a spot size of ten micrometers or less.

X-ray source 110 includes a compact electron beam accelerator 103 configured to generate electron emission 105. The stream of emitted electrons is directed by electron optics 104A and 104B through a compact undulator 106. Electron optics 104A and 104B focus and/or monochromatize the stream of electrons 105 for interaction with undulator 106. The compact electron beam accelerator 103 is sized to be compatible with a modern semiconductor fabrication facility. In some embodiments, the electron path length of the electron beam accelerator is less than 10 meters. In some embodiments, the electron beam accelerator is a laser plasma based accelerator with an acceleration length less than two meters. In some embodiments, the acceleration length of the laser plasma based accelerator is less than 25 centimeters. In some embodiments, the electron beam accelerator includes a compact storage ring. In some embodiments, the diameter of the compact storage ring has a diameter of less than 10 meters. In some embodiments, the diameter of the compact storage ring is less than five meters. In some embodiments, the electron path length through undulator 106 is also less than 10 meters. In some embodiments, undulator 106 is a magnet based undulator with an electron path length of less than ten meters. In some other embodiments, the undulator is a dielectric grating undulator with an electron path length of less than 10 meters. In some embodiments, the dielectric grating undulator has an electron path length of less than five meters. In some other embodiments, the undulator is an optical undulator with an electron path length determined by the Rayleigh length of the optical focus. In some embodiments, the electron path length of the optical undulator is less than 10 millimeters. In some embodiments, the electron path length is less than 1 millimeter. In some embodiments, the electron path length of the optical undulator is less than 100 micrometers.

Figure 2:
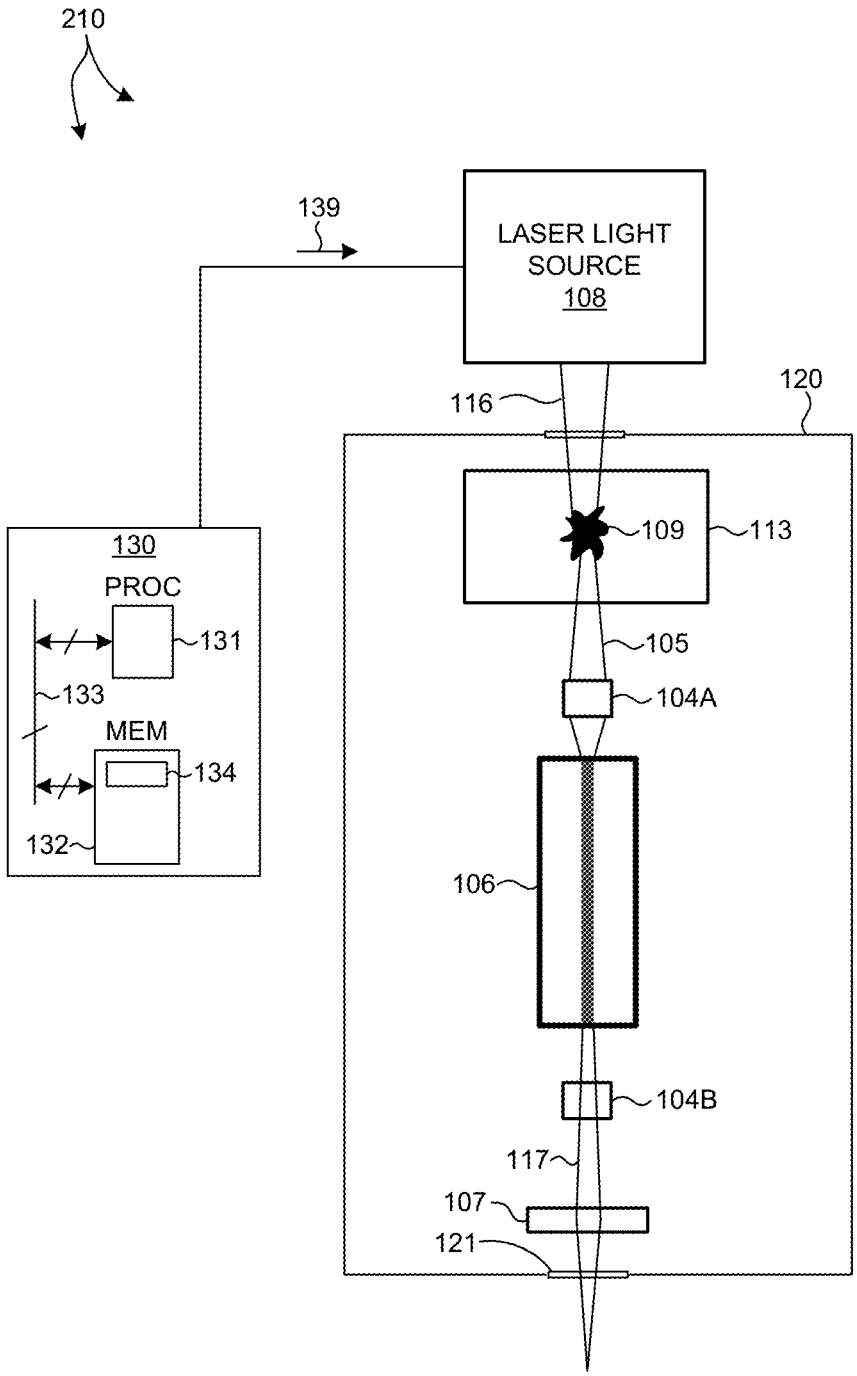
FIG. 2 is a diagram illustrative of a compact x-ray source 210 employing a laser plasma based accelerator.

In some embodiments, the electron beam accelerator 103 is plasma based. FIG. 2 depicts a compact x-ray source 210 including a plasma based electron beam accelerator in one embodiment. As illustrated in FIG. 2, compact x-ray source 210 includes similar, like numbered elements described with reference to FIG. 1. As depicted in FIG. 2, a high intensity laser light source 108 generates an amount of laser light 116 that interacts with plasma 109 in a plasma based accelerator structure 113. The interaction generates high energy electron beam 105. Such a plasma based electron beam accelerator is sometimes referred to as a Laser Wakefield Accelerator (LWFA). Employing a LWFA electron beam source may be advantageous because LWFA electron beam sources are not limited by field induced breakdown in contrast with conventional particle accelerators.

For a linearly polarized Gaussian laser pulse the laser strength parameter, $a_0$, is related to the peak laser intensity, I, by equation (1).

$$a_0 \cong 8.68 * 10^{-10} \lambda[\mu m] I^{\frac{1}{2}} [W * cm^{-2}] \quad (1)$$

The ponderomotive force of intense laser pulse 116 propagating in plasma 109 produces charge separation leading to a high field gradient, or wakefield. A particle may become trapped and focused in the wakefield leading to acceleration of the particle. This process is often referred to as "self-injection." For laser wavelengths of approximately one micrometer, a laser intensity of approximately $10^{18}$ W/cm2 is required to induce highly relativistic electron motion (i.e., $a_0 \approx 1$). Commercial lasers with repetition rates up to 1 Hz (e.g., Titanium Sapphire lasers available from Thales Optronics SA, France) are available which can reach this intensity with peak powers at TeraWatt, and even PetaWatt levels.

The performance of a laser wakefield accelerator is related to the length over which the laser is intense enough to drive wakes capable of self-injection. Usually this is limited to a few Rayleigh lengths, but with an optical guiding structure this length can be increased. Optical guiding structures are comprised of plasma channels having a minimum plasma density along a central axis with increasing plasma density from the center of the plasma channel. In some examples, optical guiding structures are created using secondary focused laser pulses to selectively heat portions of the plasma to reduce the plasma density in these areas. In some other examples, an electrical discharge is employed to generate a plasma in a capillary. Thermal conductivity at the walls of the capillary increases the plasma density at the walls relative to the plasma density along the central axis. Capillary discharge channels of a few centimeters in length have created electron beams at $10^9$ electronvolt levels containing approximately 30 pC of charge with approximately 2.5% relative energy spread and approximately one milliradian beam divergence. An exemplary system is described by W. P. Leemans et al., in "GeV electron beams from a centimeter-scale accelerator," Nature Physics 2, 696-699 (2006), the entirety of which is incorporated herein by reference.

As depicted in FIG. 1, computing system 130 is configured to communicate command signal 139 to the electron beam accelerator to control properties of the stream of electrons 105. As depicted in FIG. 2, a command signal 139 from computing system 130 is received by laser light source 108. In response, laser light source 108 may adjust the amount of optical power pumped into plasma 109, and thus adjust the electron energy of the resulting stream of electrons 105.

Figure 3:
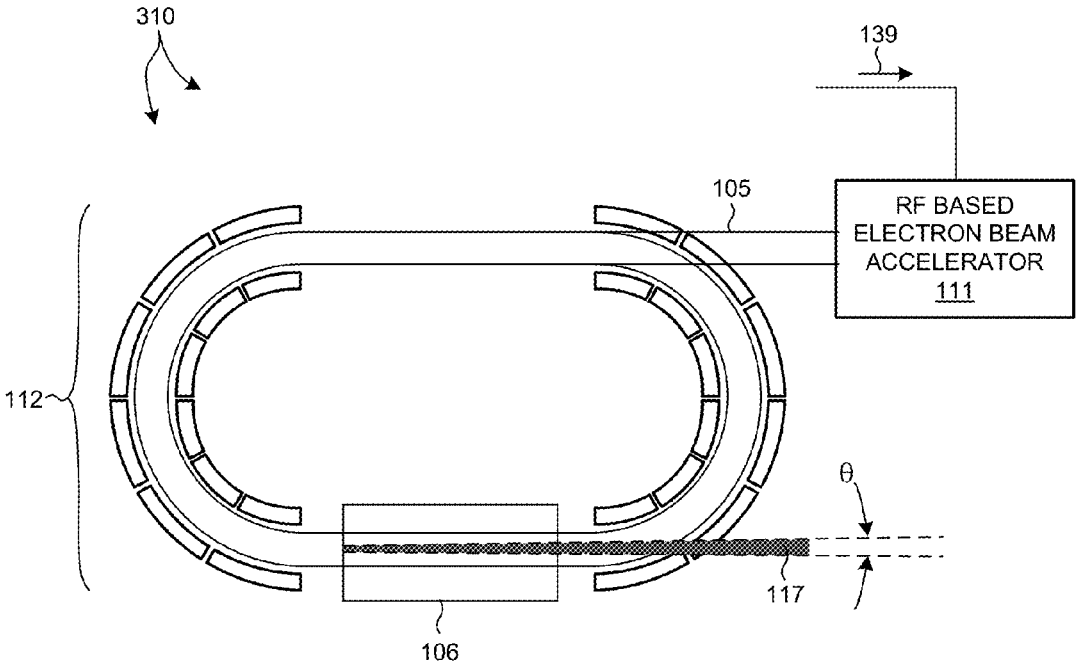
FIG. 3 is a diagram illustrative of a compact x-ray source employing a RF based electron beam accelerator.

In some other embodiments, the electron beam accelerator 103 is RF based. FIG. 3 depicts a compact x-ray source 310 in another embodiment. As illustrated in FIG. 3, compact x-ray source 310 includes similar, like numbered elements described with reference to FIG. 1. As depicted in FIG. 3, an RF based electron beam accelerator 111 generates a stream of electrons 105 directed into a compact electron storage ring 112.

Electron storage ring 112 includes suitable electromagnets, permanent magnets, or any combination of electromagnets and permanent magnets for focusing the electron beam and directing the stream of electrons 105. The stream of electrons 105 travel in a continuous electron beam path at megahertz, or even gigahertz cycle rates. In some embodiments, the electron beam path is less than 10 meters in length, and is thus suitable for integration within a semiconductor manufacturing facility. The stream of electrons 105 traveling around storage ring 112 passes through undulator 106. The interaction between the stream of electrons 105 and undulator 106 generates x-ray illumination light 117. In some embodiments, the beam divergence, θ, of x-ray illumination light 117 is less than one milliradian.

As depicted in FIG. 1, computing system 130 is configured to communicate command signal 139 to the electron beam accelerator to control properties of the stream of electrons 105. As depicted in FIG. 3, a command signal 139 from computing system 130 is received by RF based electron beam accelerator 111. In response, RF based electron beam accelerator 111 may adjust the amount of RF energy pumped into storage ring 112, and thus adjust the electron energy of the resulting stream of electrons 105.

Referring back to FIG. 1, electron optics 104A and 104B include suitable electromagnets, permanent magnets, or any combination of electromagnets and permanent magnets for focusing the electron beam and directing the stream of electrons 105. In some embodiments, electron optics 104A and 104B may include solenoids, quadrupole lenses such as Halbach cylinders or electrostatic elements such as Einzel lenses to focus and direct the electron beam. In addition, any of electron optics 104A and 104B can be configured as an electron monochromator to further reduce electron beam noise.

In addition, any of electron optics 104A and 104B may be configured for active control by computing system 130. As depicted in FIG. 1, computing system 130 is coupled to electron optics 104A and 104B. Command signals 135 and 136 are communicated to electron optics 104A and 104B, respectively. For example, current or voltage supplied electromagnetic elements may be actively controlled based on any of command signals 135 and 136. In another example, the position of a magnetic element (e.g., a permanent magnet) may be manipulated by a positioning system (not shown) based on any of command signals 135 and 136. In this manner, the focusing and directing of the stream of electrons 105 is achieved under the control of computing system 130 to achieve a stable stream of electrons 105 through undulator 106.

In a further embodiment, electron optics 104A and 104B are configured to generate a long focal length beam (e.g., greater than one meter) that passes through the undulator 106. The long focal length beam allows interaction between the stream of electrons 105 with underlator 106 over a relatively long distance.

In some embodiments, undulator 106 is a magnetic undulator. Electron beams inserted into a magnetic undulating structure generate radiation on-axis having a wavelength described by equation (2), where λu is the magnetic period, γ is the relativistic Lorentz factor of the accelerated electrons (e.g., γ~2000 for 1 GeV beams), and K is the dimensionless undulator deflection parameter described by equation (3), where B is the peak magnetic flux density in Tesla.

$$\lambda = \frac{\lambda_u}{2\gamma^2}\left(1 + \frac{K^2}{2}\right) \tag{2}$$

$$K = 93.36B[T]\lambda_u[m] \tag{3}$$

In one aspect, the wavelength of x-ray radiation generated by undulator 106 is tuned by changing the electron beam energy supplied to undulator 106 by the electron beam accelerator 103. In one example, computing system 130 communicates a command signal 139 to electron beam accelerator 103 to reduce the electron beam energy generated by the electron beam accelerator 103. As a result, the value of γ is reduced, and the wavelength of x-ray radiation generated by undulator 106 is increased as described by equation (2). Conversely, computing system 130 may communicate a command signal 139 to electron beam accelerator 103 to increase the electron beam energy generated by the electron beam accelerator 103. As a result, the value of γ is increased, and the wavelength of x-ray radiation generated by undulator 106 is decreased as described by equation (2).

Figure 4:
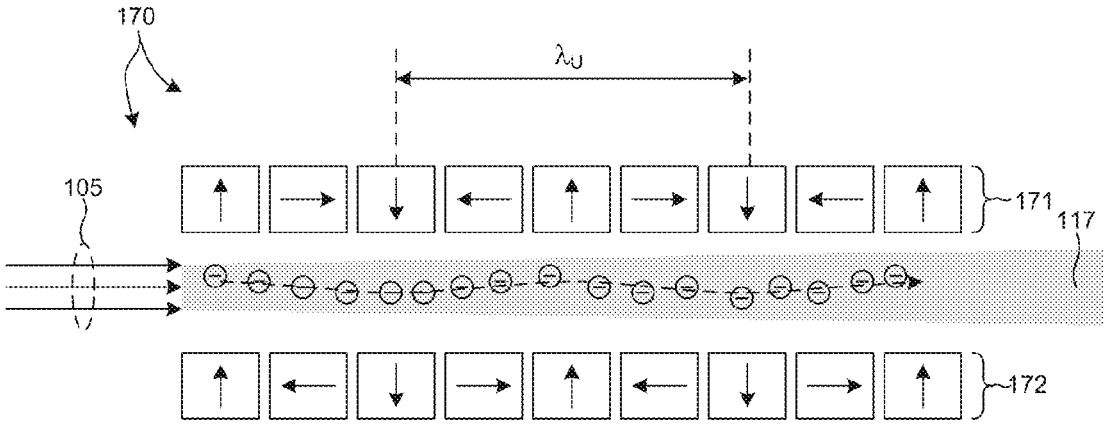
FIG. 4 is a diagram illustrative of an undulator 170 based on permanent magnets in one exemplary embodiment.

FIG. 4 illustrates an embodiment of a magnetic undulator 170 based on permanent magnets. An array of permanent magnets 171 and another array of permanent magnets 172 are placed on opposite sides of a stream of electrons 105. The polarity of the permanent magnet elements of each array are arranged such that an alternating static magnetic field is generated along the length of the undulator 170 having a magnetic period, λu. The stream of electrons 105 passing through undulator 170 is forced to undergo oscillations with a period corresponding to the magnetic period, and thus radiate energy. For permanent magnet based undulators, such as undulator 170, the magnetic period, λu, is typically one centimeter, or greater. For an undulator parameter of K=1.0 and λu=1 cm, an electron beam energy 4.4 GeV is needed to generate x-ray radiation having a wavelength of one Angstrom. An exemplary commercial system for the production of 10 GeV beams is described by W. P. Leemans et al., in "The BErkeley Lab Laser Accelerator (BELLA): A 10 GeV Laser Plasma Accelerator," Proceedings of the Fourteenth Advanced Accelerator Concepts Workshop, AIP Conference Proceedings, Volume 1299, pp. 3-11 (2010), the entirety of which is incorporated herein by reference.

In some embodiments, the wavelength of x-ray illumination light 117 generated by undulator 170 is adjusted by changing the distance between the arrays of permanent magnets 171 and 172. The change in distance changes the magnetic flux density, B, and therefore the undulator deflection parameter K, and thus the wavelength, λ.

As depicted in FIG. 1, computing system 130 is configured to communicate command signal 129 to undulator 106 to control properties of the x-ray beam 117. In one embodiment, a command signal 129 from computing system 130 is received by undulator 170 (not shown). In response, undulator 170 may adjust the gap between permanent magnet arrays 171 and 172, and thus adjust the wavelength of x-ray light 117 generated by undulator 170.

In some other embodiments, undulator 106 is a hybrid permanent magnet undulator. In these embodiments, a material with high magnetic permeability (e.g., vanadium permendur) is located within an array of permanent magnets to channel and concentrate magnetic flux, thus increasing the magnetic field strength. Such hybrid permanent magnet undulator structures are contemplated within the scope of this patent document.

Figure 5:
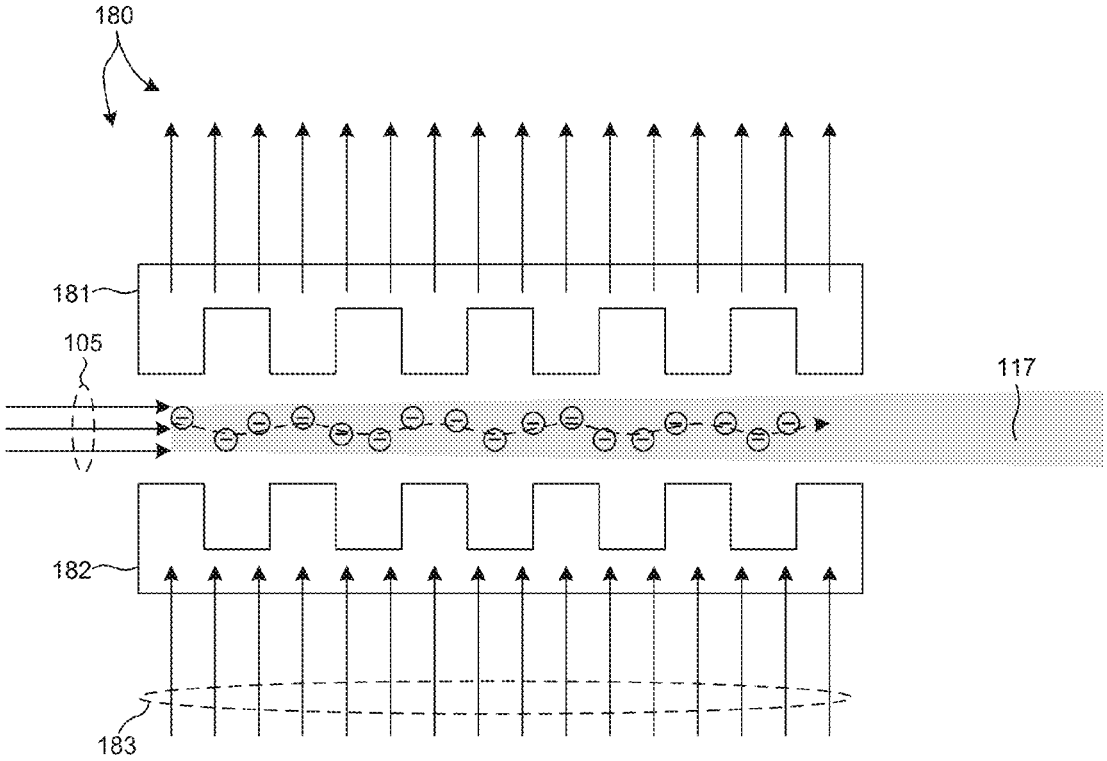
FIG. 5 is a diagram illustrative of an undulator 180 based on a dielectric structure in one exemplary embodiment.

In some other embodiments, undulator 106 is a semiconductor based dielectric undulator. FIG. 5 illustrates an embodiment 180 of a magnetic undulator based on a dielectric structure. Undulator 180 includes dielectric grating structures 181 and 182 placed on opposite sides of a stream of electrons 105. The gratings are aligned such that an alternating electric field is generated along the length of the undulator 180 when high intensity laser light 183 is passed through the dielectric structures 181 and 182. The stream of electrons 105 passing through undulator 180 is forced to undergo oscillations, and thus radiate energy. While dielectric undulators have relatively low undulator deflection parameter values (e.g., K<0.01), dielectric gratings can be produced with periods on the order of several microns. Thus, a dielectric undulator structure can generate very short wavelength radiation with a very small structure. For example, electron beam energy of 110 MeV is needed to generate x-ray radiation at one Angstrom from a dielectric based undulating structure with K=0.01 and a grating pitch of 10 micrometers. This energy level is easily attainable from current LWFA electron beam sources, and may also be generated by a conventional RF accelerator with a compact (e.g., less than 10 meter electron path length) storage ring.

As depicted in FIG. 1, computing system 130 is configured to communicate command signal 129 to undulator 106 to control properties of the x-ray beam 117. In one embodiment, a command signal 129 from computing system 130 is received by undulator 180 (not shown). In response, undulator 180 may direct the incoming stream of electrons 105 to a different grating structure having a different grating pitch, and thus adjust the wavelength of x-ray light 117 generated by undulator 180. In another embodiment, a command signal 129 from computing system 130 is received by undulator 180 (not shown). In response, undulator 180 adjusts the laser power of high intensity laser light 183. This changes the electron beam energy, and thus changes the wavelength of x-ray light 117 generated by undulator 180.

In some other embodiments, undulator 106 is an optical undulator. Electron beams inserted into an optical undulating structure generate radiation on-axis with a frequency described by equation (4), where ωl is the frequency of the incident optical undulating field, and the other parameters are as described hereinbefore.

$$\frac{1}{\omega} \approx \frac{1}{4\gamma^2\omega_l}\left(1+\frac{a_0^2}{2}\right) \tag{4}$$

Figure 6:
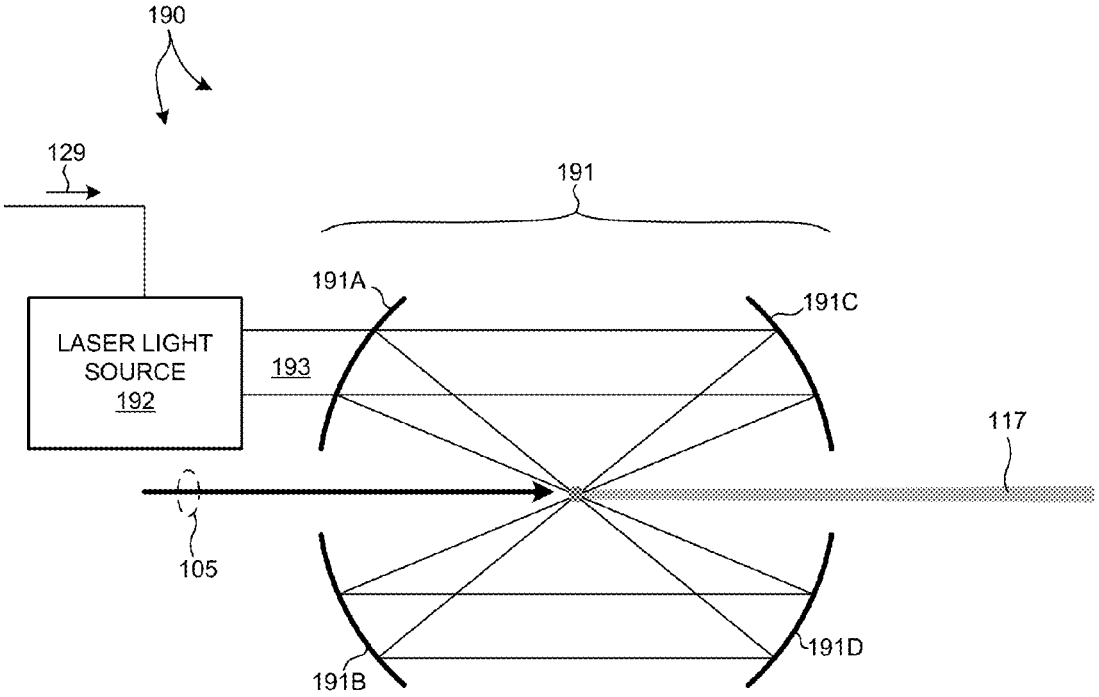
FIG. 6 is a diagram illustrative of an undulator 190 based on a four-mirror optical resonator in one exemplary embodiment.

FIG. 6 illustrates an embodiment 190 of an optical undulator based on a four-mirror optical resonator 191 including focusing mirror elements 191A-D. Laser light 193 from a laser light source 192 is pumped into optical resonator 191 to generate a standing wave in the middle of the optical resonator 191. The standing wave creates an alternating magnetic field. The stream of electrons 105 passing through the standing wave in the middle of optical resonator 191 is forced to undergo oscillations, and thus radiate energy. Although, optical resonator 191 is described with reference to a four-mirror optical resonator, in general, any optical resonator structure may be contemplated.

In one example, light generated from a 10 kW phase-locked $CO_2$ laser with a wavelength of 10.6 micrometers is inserted into an optical storage cavity with a continuous wavelength circulating power of 3 Gigawatts. At focus, the beam radius is 45 micrometers, and the laser strength parameter of the optical cavity, $a_0$, is 0.1. Under these conditions, the electron beam energy needed to generate x-ray radiation at one Angstrom is 83 MeV. This is easily attainable with current LWFA electron beam sources, and may also be generated by a conventional RF accelerator with a compact (e.g., less than 10 meter electron path length) storage ring.

As depicted in FIG. 1, computing system 130 is configured to communicate command signal 129 to undulator 106 to control properties of the x-ray beam 117. In one embodiment, a command signal 129 from computing system 130 is received by undulator 190. In response, undulator 190 may adjust the wavelength of pump light 193 generated by laser light source 192, and thus adjust the wavelength of x-ray light 117 generated by undulator 190. In another example, undulator 190 may adjust the optical power density of light stored in optical resonator 191, and thus adjust the wavelength of x-ray light 117 generated by undulator 190.

In this embodiment, the divergence of the emitted radiation is θ=1/γ. The size of the x-ray beam 117 is on the order of the size of the electron beam 105 during interaction with the undulating structure (e.g., approximately 10 micrometers). As a result, x-ray spot sizes of less than 50 micrometers may be delivered to specimen 101 without the use of x-ray optics (e.g., x-ray optics 107 illustrated in FIG. 1), and the corresponding loss of flux. In some examples, in-die semiconductor measurements may be performed without the use of x-ray optics.

In addition, the wavelength of emitted x-ray radiation is linear with the period of the undulating structure and is proportional to the inverse of the square of the energy of the electron beam. Thus, the wavelength of emitted x-ray radiation can be tuned by changing either, or both, the energy of the electron beam 105 and the wavelength of the pump light 193.

The coincidence of the stream of electrons 105 and the undulator 106 produces an x-ray beam 117 incident on inspection area 102 of specimen 101. X-ray optics 107 shape and direct incident x-ray beam 117 to specimen 101. In some examples, x-ray optics 107 monochromatize the x-ray beam that is incident on the specimen 101. In some examples, x-ray optics 107 collimate or focus the x-ray beam 117 onto inspection area 102 of specimen 101. In some embodiments, x-ray optics 107 includes one or more x-ray collimating mirrors, x-ray apertures, x-ray monochromators, and x-ray beam stops, multilayer optics, refractive x-ray optics, diffractive optics such as zone plates, or any combination thereof.

In one further aspect, in-die metrology of semiconductor targets is enabled by high-brightness x-ray radiation focused to a small spot size. In some embodiments, advanced x-ray optics such as polycapillary x-ray optics, specular optics, or optics arranged in a Loxley-Tanner-Bowen configuration are employed to achieve high-brightness, small spot size illumination of a semiconductor specimen. For example, high intensity x-ray beams can be transported and focused to spot sizes of less than 40 micrometers using specular x-ray optics such as grazing incidence ellipsoidal mirrors, polycapillary optics such as hollow capillary x-ray waveguides, multilayer optics, or crystalline optics such as a Loxley-Tanner-Bowen system. Exemplary optical systems for transmission and focusing of high intensity x-ray beams are described by D. K. Bowen and B. K. Tanner in "High Resolution X-Ray Diffractometry and Topography," Taylor and Francis, London, 1998, the entirety of which is incorporated herein by reference.

In addition, in some embodiments, multilayer optics are employed to select the x-ray energy as well as monochromatize the x-ray beam 117 to a spectral purity, $\delta\lambda/\lambda$, of less than $10^{-3}$. This level of spectral purity is suitable for metrology technologies such as x-ray reflectivity (XRR), x-ray diffraction (XRD), transmission small-angle x-ray spectroscopy (T-SAXS), and x-ray fluorescence (XRF). In some other embodiments, crystal monochromators are employed to monochromatize the x-ray beam 117 to a spectral purity, $\delta\lambda/\lambda$, of less than $10^{-5}$. This level of spectral purity is suitable for metrology technologies such as high resolution x-ray diffraction (HRXRD) and x-ray photoelectron spectroscopy (XPS).

X-ray optics 107 may be configured for active control by computing system 130. As depicted in FIG. 1, computing system 130 is coupled to x-ray optics 107. Command signal 137 is communicated to x-ray optics 107 from computing system 130. For example, the position of an optical element may be manipulated by a positioning system (not shown) based on command signal 137. In this manner, the focusing and directing of the x-ray beam 117 is achieved under the control of computing system 130 to achieve a stable illumination incident on specimen 101. In some examples, computing system 130 is configured to control the positioning and spot size of the x-ray beam 117 incident on specimen 101 based on command signal 137. In some examples, computing system 130 is configured to control illumination properties of the x-ray beam 117 (e.g., intensity, polarization, spectrum, etc.) based on command signal 137.

In some embodiments, a localized gas purge is directed onto specimen 101 to further reduce noise introduced into the x-ray beam 117 by environmental disturbances.

In some embodiments, x-ray source 110 is maintained in the same atmospheric environment as specimen 101 (e.g., gas purge environment). However, in some embodiments, the distance between specimen 101 and electron beam accelerator 103 is lengthy (e.g., greater than one meter). In these embodiments, environmental disturbances (e.g., air turbulence) contribute noise to the illumination light and detected signals. Hence in some embodiments, portions of x-ray source 110 (e.g., any of electron beam accelerator 103, electron optics 104A and 104B, undulator 106, and x-ray optics 107) are maintained in a localized vacuum environment separated from the specimen by vacuum windows. For example, as depicted in FIG. 1, a vacuum environment is maintained within vacuum chamber 120 that contains many elements of x-ray source 110. These elements are separated from specimen 101 by a vacuum window 121. In the embodiment depicted in FIG. 1, x-ray optics 107 are located within vacuum chamber 120. However, in some other embodiments, x-ray optics 107 are located outside of vacuum chamber 120, between window 121 and specimen 101.

As depicted in FIG. 1, in some embodiments, detector 126 collects radiation 125 scattered from specimen 101 and generates an output signal 138 indicative of properties of specimen 101 that are sensitive to the incident x-ray radiation. In some embodiments, detector 126 is configured to collect other particles produced during the interaction such as photoelectrons, x-rays produced through fluorescence, or ions. Scattered x-rays 125 are collected by detector 126 while specimen positioning system 140 locates and orients specimen 101 to produce angularly resolved scattered x-rays. The detector 126 is able to resolve one or more x-ray photon energies and produces signals for each x-ray energy component indicative of properties of the specimen. In some embodiments, the detector 126 includes any of a CCD array, a microchannel plate, a photodiode array, a microstrip proportional counter, a gas filled proportional counter, and a scintillator. In some embodiments, single photon counting detectors with high dynamic range increase the signal to noise ratio of output signal 127.

In some embodiments, the detector 126 is an energy resolving x-ray detector. Such a detector may enable high throughput semiconductor metrology measurements by relaxing the spectral purity requirements of the incident x-ray beam. This allows a higher flux to reach the surface of specimen 101 than would otherwise be practical.

Figure 8:
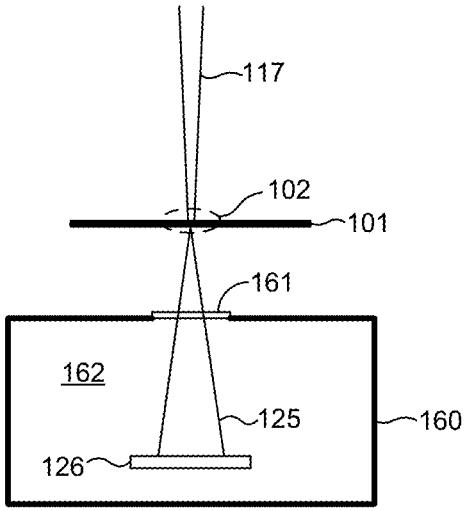
FIG. 8 is a diagram illustrative of an x-ray detector 126 of x-ray metrology system 100 contained in a vacuum environment 162 separate from specimen 101.

In some embodiments, the detector 126 is maintained in the same atmospheric environment as specimen 101 (e.g., gas purge environment). However, in some embodiments, the distance between specimen 101 and detector 126 is lengthy (e.g., greater than one meter). In these embodiments, environmental disturbances (e.g., air turbulence) contribute noise to the detected signals. Hence in some embodiments, detector 126 is maintained in a localized, vacuum environment separated from the specimen (e.g., specimen 101) by a vacuum window. FIG. 8 is a diagram illustrative of a vacuum chamber 160 containing detector 126. In a preferred embodiment, vacuum chamber 160 includes a substantial portion of the path between specimen 101 and detector 126. An opening of vacuum chamber 160 is covered by vacuum window 161. Vacuum window 161 may be constructed of any suitable material that is substantially transparent to x-ray radiation (e.g., Beryllium). Scattered x-ray radiation 125 passes through vacuum window 161, enters vacuum chamber 160 and is incident on detector 126. A suitable vacuum environment 162 is maintained within vacuum chamber 160 to minimize disturbances to scattered x-ray radiation 125.

By way of non-limiting example, the x-ray metrology system 100 illustrated in FIG. 1 is configured as a transmission small angle x-ray scatterometer (TSAXS). However, in general, x-ray metrology system 100 employing a compact, high brightness x-ray source as described herein may employ any one or more of the following metrology techniques: small angle x-ray scattering (SAXS), grazing incidence small angle x-ray scattering (GISAXS), wide angle x-ray scattering (WAXS), x-ray reflectivity (XRR), x-ray diffraction (XRD), grazing incidence x-ray diffraction (GIXRD), high resolution x-ray diffraction (HRXRD), x-ray photoelectron spectroscopy (XPS), x-ray fluorescence (XRF), grazing incidence x-ray fluorescence (GIXRF), x-ray tomography, and x-ray ellipsometry.

X-ray metrology tool 100 also includes computing system 130 employed to acquire signals 138 generated by detector 126 and determine properties of the specimen based at least in part on the acquired signals. As illustrated in FIG. 1, computing system 130 is communicatively coupled to detector 126. In one example, detector 126 is an x-ray spectrometer and measurement data 138 includes an indication of the measured spectral response of the specimen based on one or more sampling processes implemented by the x-ray spectrometer. Computing system 130 is configured to build models of the specimen, create x-ray simulations based upon the models, and analyze the simulations and signals received from detector 126 to determine one or more characteristics of the sample.

In a further embodiment, computing system 130 is configured to access model parameters in real-time, employing Real Time Critical Dimensioning (RTCD), or it may access libraries of pre-computed models for determining a value of at least one specimen parameter value associated with the specimen 101. In general, some form of CD-engine may be used to evaluate the difference between assigned CD parameters of a specimen and CD parameters associated with the measured specimen. Exemplary methods and systems for computing specimen parameter values are described in U.S. Pat. No. 7,826,071, issued on Nov. 2, 2010, to KLA-Tencor Corp., the entirety of which is incorporated herein by reference.

In one example, measurement data 138 includes an indication of the measured x-ray response of the specimen. Based on the distribution of the measured x-ray response on the surface of detector 126, the location and area of incidence of x-ray beam 117 on specimen 101 is determined by computing system 130. In one example, pattern recognition techniques are applied by computing system 130 to determine the location and area of incidence of x-ray beam 117 on specimen 101 based on measurement data 127. In response computing system 130 generates any of command signals 135, 136, and 137, to electron optics 104A and 104B, and x-ray optics 119, respectively, to redirect and reshape incident x-ray illumination beam 117.

In another aspect, x-ray measurements of a particular inspection area are performed at a number of different out of plane orientations. This increases the precision and accuracy of measured parameters and reduces correlations among parameters by extending the number and diversity of data sets available for analysis to include a variety of large-angle, out of plane orientations. Measuring specimen parameters with a deeper, more diverse data set also reduces correlations among parameters and improves measurement accuracy.

As illustrated in FIG. 1, x-ray metrology system 100 includes a specimen positioning system 140 configured to both align specimen 101 and orient specimen 101 over a large range of out of plane angular orientations with respect the x-ray source. In other words, specimen positioning system 140 is configured to rotate specimen 101 over a large angular range about one or more axes of rotation aligned in-plane with the surface of specimen 101. In some embodiments, specimen positioning system 140 is configured to rotate specimen 101 within a range of at least 90 degrees about one or more axes of rotation aligned in-plane with the surface of specimen 101. In some embodiments, specimen positioning system is configured to rotate specimen 101 within a range of at least 60 degrees about one or more axes of rotation aligned in-plane with the surface of specimen 101. In some other embodiments, specimen positioning system is configured to rotate specimen 101 within a range of at least one degree about one or more axes of rotation aligned in-plane with the surface of specimen 101. In this manner, angle resolved measurements of specimen 101 are collected by x-ray metrology system 100 over any number of locations on the surface of specimen 101. In one example, computing system 130 communicates command signals 147 to motion controller 145 of specimen positioning system 140 that indicate the desired position of specimen 101. In response, motion controller 145 generates command signals to the various actuators of specimen positioning system 140 to achieve the desired positioning of specimen 101. By way of non-limiting example, a specimen positioning system may include any combination of a hexapod, linear, and angular stages.

By way of non-limiting example, as illustrated in FIG. 1, specimen positioning system 140 includes an edge grip chuck 141 to fixedly attach specimen 101 to specimen positioning system 140. A rotational actuator 142 is configured to rotate edge grip chuck 141 and the attached specimen 101 with respect to a perimeter frame 143. In the depicted embodiment, rotational actuator 142 is configured to rotate specimen 101 about the x-axis of the coordinate system 146 illustrated in FIG. 1. As depicted in FIG. 1, a rotation of specimen 101 about the z-axis is an in plane rotation of specimen 101. Rotations about the x-axis and the y-axis (not shown) are out of plane rotations of specimen 101 that effectively tilt the surface of the specimen with respect to the metrology elements of metrology system 100. Although it is not illustrated, a second rotational actuator is configured to rotate specimen 101 about the y-axis. A linear actuator 144 is configured to translate perimeter frame 143 in the x-direction. Another linear actuator (not shown) is configured to translate perimeter frame 143 in the y-direction. In this manner, every location on the surface of specimen 101 is available for measurement over a range of out of plane angular positions. For example, in one embodiment, a location of specimen 101 is measured over several angular increments within a range of −45 degrees to +45 degrees with respect to the normal orientation of specimen 101.

The large, out of plane, angular positioning capability of specimen positioning system 140 expands measurement sensitivity and reduces correlations between parameters. For example, in a normal orientation, SAXS is able to resolve the critical dimension of a feature, but is largely insensitive to sidewall angle and height of a feature. However, by collecting measurement data over a broad range of out of plane angular positions, the sidewall angle and height of a feature can be resolved.

An x-ray metrology tool employing a high brightness x-ray source as described herein enables increased measurement sensitivity and throughput due to the high brightness and short wavelength radiation (e.g., less than one Angstrom) generated by the source. By way of non-limiting example, the x-ray metrology tool is capable of measuring geometric parameters (e.g., pitch, critical dimension (CD), side wall angle (SWA), line width roughness (LWR), and line edge roughness (LER)) of structures smaller than 10 nanometers. In addition, the high energy nature of x-ray radiation penetrates optically opaque thin films, buried structures, high aspect ratio structures, and devices including many thin film layers.

An x-ray metrology system employing a high brightness x-ray source as described herein may be used to determine characteristics of semiconductor structures. Exemplary structures include, but are not limited to, FinFETs, low-dimensional structures such as nanowires or graphene, sub 10 nm structures, thin films, lithographic structures, through silicon vias (TSVs), memory structures such as DRAM, DRAM 4F2, FLASH and high aspect ratio memory structures. Exemplary structural characteristics include, but are not limited to, geometric parameters such as line edge roughness, line width roughness, pore size, pore density, side wall angle, profile, film thickness, critical dimension, pitch, and material parameters such as electron density, crystalline grain structure, morphology, orientation, stress, and strain.

It should be recognized that the various steps described throughout the present disclosure may be carried out by a single computer system 130 or, alternatively, a multiple computer system 130. Moreover, different subsystems of the system 100, such as the specimen positioning system 140, may include a computer system suitable for carrying out at least a portion of the steps described herein. Therefore, the aforementioned description should not be interpreted as a limitation on the present invention but merely an illustration. Further, the one or more computing systems 130 may be configured to perform any other step(s) of any of the method embodiments described herein.

In addition, the computer system 130 may be communicatively coupled to detector 126, electron optics 104A and 104B, x-ray optics 119, undulator 106, electron beam accelerator 103, and wafer positioning system 140 in any manner known in the art. For example, the one or more computing systems 130 may be coupled to computing systems associated with detector 126, electron optics 104A and 104B, x-ray optics 119, undulator 106, electron beam accelerator 103, and wafer positioning system 140, respectively. In another example, any of detector 126, electron optics 104A and 104B, x-ray optics 119, undulator 106, electron beam accelerator 103, and wafer positioning system 140 may be controlled directly by a single computer system coupled to computer system 130.

The computer system 130 of the x-ray metrology system 100 may be configured to receive and/or acquire data or information from the subsystems of the system (e.g., detector 126, electron optics 104A and 104B, x-ray optics 119, and the like) by a transmission medium that may include wireline and/or wireless portions. In this manner, the transmission medium may serve as a data link between the computer system 130 and other subsystems of the system 100.

Computer system 130 of the combined metrology system 100 may be configured to receive and/or acquire data or information (e.g., measurement results, modeling inputs, modeling results, etc.) from other systems by a transmission medium that may include wireline and/or wireless portions. In this manner, the transmission medium may serve as a data link between the computer system 130 and other systems (e.g., memory on-board metrology system 100, external memory, or external systems). For example, the computing system 130 may be configured to receive measurement data (e.g., output signals 138) from a storage medium (i.e., memory 132) via a data link. For instance, spectral results obtained using a spectrometer of x-ray detector 126 may be stored in a permanent or semi-permanent memory device (e.g., memory 132). In this regard, the spectral results may be imported from on-board memory or from an external memory system. Moreover, the computer system 130 may send data to other systems via a transmission medium. For instance, specimen parameter values determined by computer system 130 may be stored in a permanent or semi-permanent memory device. In this regard, measurement results may be exported to another system.

Computing system 130 may include, but is not limited to, a personal computer system, mainframe computer system, workstation, image computer, parallel processor, or any other device known in the art. In general, the term "computing system" may be broadly defined to encompass any device having one or more processors, which execute instructions from a memory medium.

Program instructions 134 implementing methods such as those described herein may be transmitted over a transmission medium such as a wire, cable, or wireless transmission link. For example, as illustrated in FIG. 1, program instructions stored in memory 132 are transmitted to processor 131 over bus 133. Program instructions 134 are stored in a computer readable medium (e.g., memory 132). Exemplary computer-readable media include read-only memory, a random access memory, a magnetic or optical disk, or a magnetic tape.

In some embodiments, x-ray metrology as described herein is implemented as part of a fabrication process tool. Examples of fabrication process tools include, but are not limited to, lithographic exposure tools, film deposition tools, implant tools, and etch tools. In this manner, the results of x-ray measurements are used to control a fabrication process. In one example, x-ray measurement data collected from one or more targets is sent to a fabrication process tool. The x-ray data is analyzed and the results used to adjust the operation of the fabrication process tool.

Figure 7:
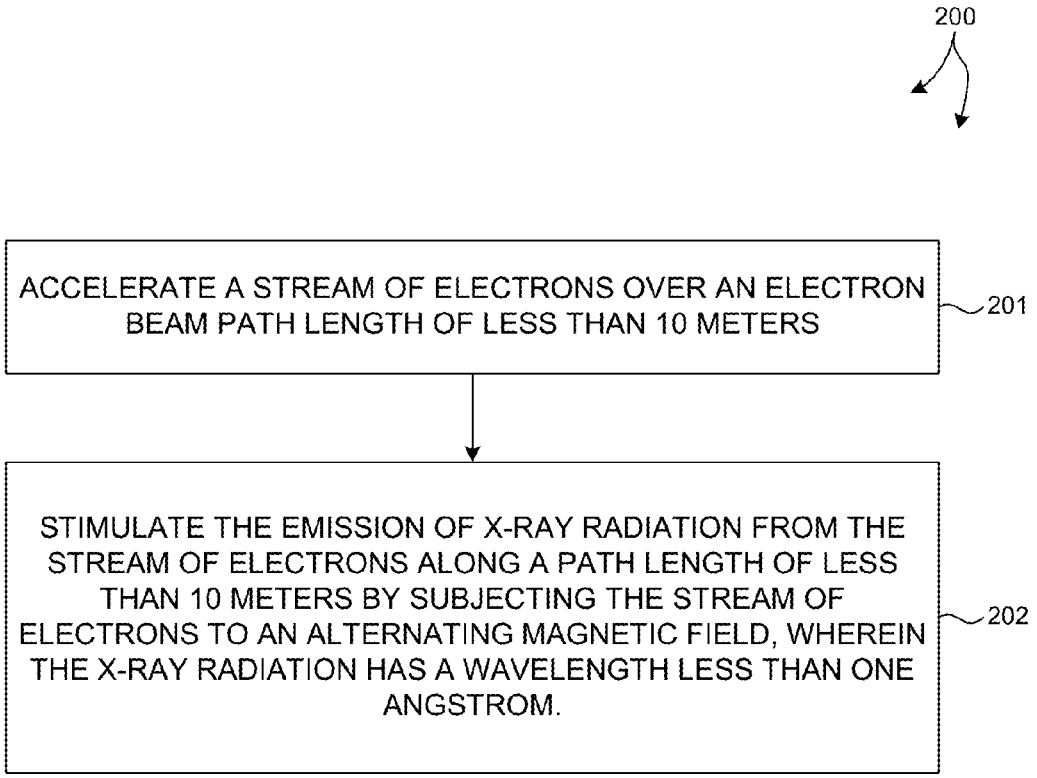
FIG. 7 is a flowchart illustrative of an exemplary method 200 suitable for generating an amount of x-ray radiation suitable performing semiconductor metrology measurements.

FIG. 7 illustrates a method 200 suitable for implementation by the x-ray metrology system 100 of the present invention. While the following description is presented in the context of x-ray metrology system 100, it is recognized herein that the particular structural aspects of x-ray metrology system 100 do not represent limitations and should be interpreted as illustrative only.

In block 201, a stream of electrons is accelerated over an electron beam path length of less than 10 meters.

In block 202, the emission of x-ray radiation is stimulated from the stream of electrons along a path length of less than 10 meters by subjecting the stream of electrons to an alternating magnetic field. The resulting x-ray radiation has a wavelength less than one Angstrom. In a further aspect, the beam divergence of the x-ray radiation is less than one milliradian.

As described herein, the term "critical dimension" includes any critical dimension of a structure (e.g., bottom critical dimension, middle critical dimension, top critical dimension, sidewall angle, grating height, etc.), a critical dimension between any two or more structures (e.g., distance between two structures), and a displacement between two or more structures (e.g., overlay displacement between overlaying grating structures, etc.). Structures may include three dimensional structures, patterned structures, overlay structures, etc.

As described herein, the term "critical dimension application" or "critical dimension measurement application" includes any critical dimension measurement.

As described herein, the term "metrology system" includes any system employed at least in part to characterize a specimen in any aspect, including critical dimension applications and overlay metrology applications. However, such terms of art do not limit the scope of the term "metrology system" as described herein. In addition, the metrology system 100 may be configured for measurement of patterned wafers and/or unpatterned wafers. The metrology system may be configured as a LED inspection tool, edge inspection tool, backside inspection tool, macro-inspection tool, or multi-mode inspection tool (involving data from one or more platforms simultaneously), and any other metrology or inspection tool that benefits from the calibration of system parameters based on critical dimension data as well as composition data.

Various embodiments are described herein for a semiconductor processing system (e.g., an inspection system or a lithography system) that may be used for processing a specimen. The term "specimen" is used herein to refer to a wafer, a reticle, or any other sample that may be processed (e.g., printed or inspected for defects) by means known in the art.

As used herein, the term "wafer" generally refers to substrates formed of a semiconductor or non-semiconductor material. Examples include, but are not limited to, monocrystalline silicon, gallium arsenide, and indium phosphide. Such substrates may be commonly found and/or processed in semiconductor fabrication facilities. In some cases, a wafer may include only the substrate (i.e., bare wafer). Alternatively, a wafer may include one or more layers of different materials formed upon a substrate. One or more layers formed on a wafer may be "patterned" or "unpatterned." For example, a wafer may include a plurality of dies having repeatable pattern features.

A "reticle" may be a reticle at any stage of a reticle fabrication process, or a completed reticle that may or may not be released for use in a semiconductor fabrication facility. A reticle, or a "mask," is generally defined as a substantially transparent substrate having substantially opaque regions formed thereon and configured in a pattern. The substrate may include, for example, a glass material such as amorphous $SiO_2$. A reticle may be disposed above a resist-covered wafer during an exposure step of a lithography process such that the pattern on the reticle may be transferred to the resist.

One or more layers formed on a wafer may be patterned or unpatterned. For example, a wafer may include a plurality of dies, each having repeatable pattern features. Formation and processing of such layers of material may ultimately result in completed devices. Many different types of devices may be formed on a wafer, and the term wafer as used herein is intended to encompass a wafer on which any type of device known in the art is being fabricated.

In one or more exemplary embodiments, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. An x-ray based metrology system, comprising:

a compact x-ray illumination source configured to illuminate an inspection area of a semiconductor wafer with an incident x-ray beam, wherein the compact x-ray illumination source includes, a compact electron beam accelerator configured to accelerate a stream of electrons, wherein an electron beam path length of the compact electron beam accelerator is less than 10 meters, and a compact undulator configured to subject the stream of electrons to an alternating magnetic field and stimulate the emission of x-ray radiation having a wavelength less than one Angstrom, wherein an electron beam path length through the compact undulator is less than 10 meters; and a detector configured to receive radiation from the semiconductor wafer in response to the incident x-ray beam and generate signals indicative of a first property of the semiconductor wafer;

a specimen positioning system configured to selectively position the semiconductor wafer at a plurality of different orientations out of plane with respect to the compact x-ray illumination source; and a computing system configured to determine a location and an area of incidence of the incident x-ray beam on the semiconductor wafer based on a distribution of the radiation received on the detector and generate one or more command signals that cause the incident x-ray beam to be redirected to a different location on the semiconductor wafer based on the determined location and area of incidence.

2. The x-ray based metrology system of claim 1, wherein the compact undulator includes a dielectric grating structure, and wherein the wavelength of the x-ray radiation emitted from the compact undulator is tunable based on a spatial period of a dielectric grating.

3. The x-ray based metrology system of claim 1, wherein the compact undulator is an optical undulator, and wherein the wavelength of the x-ray radiation emitted from the compact undulator is tunable based on a wavelength of a pump laser light of the optical undulator.

4. The x-ray based metrology system of claim 1, wherein the compact undulator is a magnetic undulator including a first array of permanent magnets and a second array of permanent magnets, wherein the stream of electrons passes between the first and second arrays of permanent magnets, and wherein the wavelength of the x-ray radiation emitted from the compact undulator is tunable based on a distance between the first and second arrays of permanent magnets.

5. The x-ray based metrology system of claim 1, further comprising:

an electron beam storage ring configured to direct the stream of electrons in a looped electron beam path that includes the compact undulator.

6. The x-ray based metrology system of claim 5, wherein the electron beam accelerator is a Radio Frequency (RF) based accelerator.

7. The x-ray based metrology system of claim 1, wherein the electron beam accelerator is a plasma based accelerator.

8. The x-ray based metrology system of claim 1, further comprising:

at least one electron optical element configured to focus the stream of electrons to generate a long focal length electron beam that passes through the compact undulator.

9. The x-ray based metrology system of claim 1, further comprising:

at least one x-ray optical element configured to focus an amount of x-ray radiation generated by an interaction of the stream of electrons with the compact undulator onto an inspection area having a spot size of less than 50 micrometers.

10. The x-ray based metrology system of claim 1, further comprising:

at least one electron optical element configured to monochromatize the stream of electrons before interaction with the compact undulator.

11. The x-ray based metrology system of claim 1, further comprising:

a computing system configured to communicate a first control signal to at least one electron optical element, wherein the at least one electron optical element is configured to focus the stream of electrons toward the compact undulator in response to the first control signal, and wherein the computing system is also configured to communicate a second control signal to at least one x-ray optical element, wherein the at least one x-ray optical element is configured to focus an amount of x-ray radiation generated by the interaction the stream of electrons with the compact undulator toward a specimen in response to the second control signal.

12. The x-ray metrology system of claim 10, wherein the x-ray metrology system is configured to perform any of transmission small angle x-ray scattering (TSAXS), grazing incidence small angle x-ray scattering (GISAXS), wide angle x-ray scattering (WAXS), x-ray reflectivity (XRR), x-ray diffraction (XRD), grazing incidence x-ray diffraction (GIXRD), high resolution x-ray diffraction (HRXRD), x-ray photoelectron spectroscopy (XPS), x-ray fluorescence (XRF), grazing incidence x-ray fluorescence (GIXRF), x-ray tomography, and x-ray ellipsometry measurements.

13. A compact x-ray illumination source, comprising:

a compact electron beam accelerator configured to accelerate a stream of electrons, wherein an electron beam path length of the compact electron beam accelerator is less than 10 meters;

a compact undulator configured to subject the stream of electrons to an alternating magnetic field and stimulate the emission of x-ray radiation having a wavelength less than one Angstrom and a beam divergence of less than one milliradian, wherein an electron beam path length through the compact undulator is less than 10 meters;

multilayer x-ray optics configured to select an x-ray energy from the x-ray radiation, focus the x-ray radiation onto a semiconductor wafer over an inspection area, and monochromatize the x-ray radiation to a spectral purity of less than $10^{-3}$;

a specimen positioning system configured to selectively position the semiconductor wafer at a plurality of different orientations out of plane with respect to the x-ray radiation incident onto the semiconductor wafer over the inspection area; and a computing system configured to determine a location and an area of incidence of the incident x-ray radiation on the semiconductor wafer based on a distribution of the radiation received on a detector and generate one or more command signals that cause the incident x-ray radiation to be redirected to a different location on the semiconductor wafer based on the determined location and area of incidence.

14. The compact x-ray illumination source of claim 13, wherein the compact undulator includes a dielectric grating structure, and wherein the wavelength of the x-ray radiation emitted from the compact undulator is changed based on a change of a spatial period of the dielectric grating structure.

15. The compact x-ray illumination source of claim 13, wherein the compact undulator is an optical undulator, and wherein the wavelength of the x-ray radiation emitted from the compact undulator is changed based on a change of wavelength of a pump laser light of the optical undulator.

16. The compact x-ray illumination source of claim 13, wherein the wavelength of the x-ray radiation emitted from the compact undulator is changed based on a change of an electron beam energy of the stream of electrons accelerated by the compact electron beam accelerator.

17. A method comprising:

accelerating a stream of electrons over an electron beam path length of less than 10 meters; and stimulating the emission of x-ray radiation from the stream of electrons along a path length of less than 10 meters by subjecting the stream of electrons to an alternating magnetic field, wherein the x-ray radiation has a wavelength less than one Angstrom;

selectively positioning a semiconductor wafer at a plurality of different orientations out of plane with respect to a compact x-ray illumination source configured to illuminate an inspection area of the semiconductor wafer with the x-ray radiation;

determining a location and an area of incidence of the incident x-ray radiation on the semiconductor wafer based on a distribution of the radiation received on a detector; and generating one or more command signals that cause the incident x-ray radiation to be redirected to a different location on the semiconductor wafer based on the determined location and area of incidence.

18. The method of claim 17, wherein the stimulating of the emission of the x-ray radiation involves passing the stream of electrons through a dielectric grating structure illuminated by an amount of laser light, and wherein the wavelength of the x-ray radiation is based on a spatial period of the dielectric grating structure.

19. The method of claim 17, wherein the stimulating of the emission of the x-ray radiation involves passing the stream of electrons through a standing optical wave within an optical resonator, and further comprising:

optically pumping the optical resonator with illumination light generated by a laser light source, wherein the wavelength of the x-ray radiation is based on a wavelength of the illumination light and a power density of standing optical wave.

20. The method of claim 19, further comprising:

receiving a control signal at the laser light source that causes the laser light source to adjust a wavelength of the illumination light.

* * * * *